US005755394A

United States Patent [19]

Cordova

[11] Patent Number: 5,755,394

[45] Date of Patent: May 26, 1998

[54] SKI ROPE KEEL

[76] Inventor: Steve Simon Cordova, P.O. Box 379, Townsend, Mont. 59644

[21] Appl. No.: 630,990

[22] Filed: Apr. 12, 1996

[51] Int. Cl.[6] ..... B65H 75/38

[52] U.S. Cl. ..... 242/405.3; 242/587.1; 242/904

[58] Field of Search ..... 242/400.1, 405, 242/405.3, 587.1, 904

[56] References Cited

U.S. PATENT DOCUMENTS

| | | | |
|---|---|---|---|
| D. 310,776 | 9/1990 | Cason . | |
| 690,588 | 1/1902 | Krex | 242/405.3 X |
| 1,210,909 | 1/1917 | Copersito | 242/587.1 |
| 1,827,439 | 10/1931 | Reimer | 242/405.3 X |
| 2,998,796 | 9/1961 | Wittrock | 242/86.5 |
| 3,208,586 | 9/1965 | Wilson . | |
| 3,326,493 | 6/1967 | Bondesen et al. | 242/904 X |
| 3,494,570 | 2/1970 | Jones, Jr. | 242/405.3 X |
| 4,429,839 | 2/1984 | Jessamine | 242/405.3 X |
| 4,520,239 | 5/1985 | Schwartz . | |
| 5,014,925 | 5/1991 | Cump | 242/405.3 |
| 5,020,737 | 6/1991 | Sehl . | |
| 5,086,988 | 2/1992 | LaPoint et al. | 242/405 X |

*Primary Examiner*—Daniel P. Stodola
*Assistant Examiner*—Gregory J. Strimbu
*Attorney, Agent, or Firm*—Richard C. Litman

[57] ABSTRACT

A ski rope holder which allows a user to wind up a ski rope without tangling it and to store it in a small space. The ski rope holder has a spool mounted inside of a housing. The spool, which is operated by a crank located on the outside of the housing, mounts a lead rope. The lead rope has a hook for attaching to a ski rope. The housing also mounts a handle, for easy operation of the ski rope holder, and a clip, for the attachment of a ski rope handle during storage. In use, a ski rope that is attached to the lead rope of the ski holder can be wound up and payed out as necessary. When the rope is fully out, the ski rope can be disconnected from the ski rope holder and attached to a hook on the rear of the boat. This attachment to the rear of the boat insures that the ski rope will not become entangled with the motor of the boat.

4 Claims, 7 Drawing Sheets

SKI ROPE KEEL

BACKGROUND OF THE INVENTION

1. Field of the Invention

The present invention relates to water skiing and, more particularly, to a ski rope holder.

2. Description of the Prior Art

The present invention is a ski rope holder for reeling in a ski rope and storing it inside of a housing. One end of a lead rope is attached to a reel assembly in the ski rope holder. The other end of the lead rope has a hook which attaches to a ski rope. As the reel assembly is rotated, by a crank operatively attached to a spool, the lead rope and any attached ski rope are wound into the housing. After the rope is wound into the housing, the ski rope handle can be stored by mounting it on a clip attached to the housing of the ski rope holder.

U.S. Pat. Nos. 3,208,586, issued on Sep. 28, 1965 to Robert M. Wilson, 3,494,570, issued on Feb. 10, 1970 to John Paul Jones, Jr., 4,429,839, issued on Feb. 7, 1984 to Donald W. Jessamine, 5,020,737, issued on Jun. 4, 1991 to Douglas Sehl, and Des. 310,776, issued on Sep. 25, 1990 to Larry Cason, teach ski rope reels or winding devices. However, none of these devices have the instant housing, lead rope, and ski rope handle clip of the instant invention.

U.S. Pat. Nos. 4,520,239, issued on May 28, 1985 to Frederic W. Schwartz, and 5,014,925, issued on May 14, 1991 to Charles Cump, teach reels for storage of lengths of material such as electrical cords or garden hoses. These patents conspicuously lack the instant lead rope and clip.

The present invention defines over and improves on the prior art in many ways, including its provision of a lead rope and a ski rope handle clip.

None of the above inventions and patents, taken either singly or in combination, is seen to describe the instant invention as claimed.

SUMMARY OF THE INVENTION

The ski rope holder of the present invention allows a user to wind up a ski rope without tangling it and to store it in a small space. The ski rope holder has a spool mounted inside of a housing. The spool, which is operated by a crank located on the outside of the housing, mounts a lead rope. The lead rope has a hook for attaching to a ski rope. The housing also mounts a handle, for easy operation of the ski rope holder, and a clip, for the attachment of a ski rope handle during storage.

In use, a ski rope that is attached to the lead rope of the ski holder can be wound up and payed out as necessary. When the rope is fully out, the ski rope can be disconnected from the ski rope holder and attached to a hook, or other coupling means, on the rear of the boat. This attachment to the rear of the boat insures that the ski rope will not become entangled with the motor of the boat.

Accordingly, it is a principal object of the invention to provide a ski rope holder that allows for the easy winding up and storage of a ski rope.

It is another object of the invention to devise a holder from which the ski rope can be easily detached.

It is a further object of the invention to provide a device with a clip on which to mount a ski rope handle.

Still another object of the invention is to provide a system in which the ski rope is kept away from the motor.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
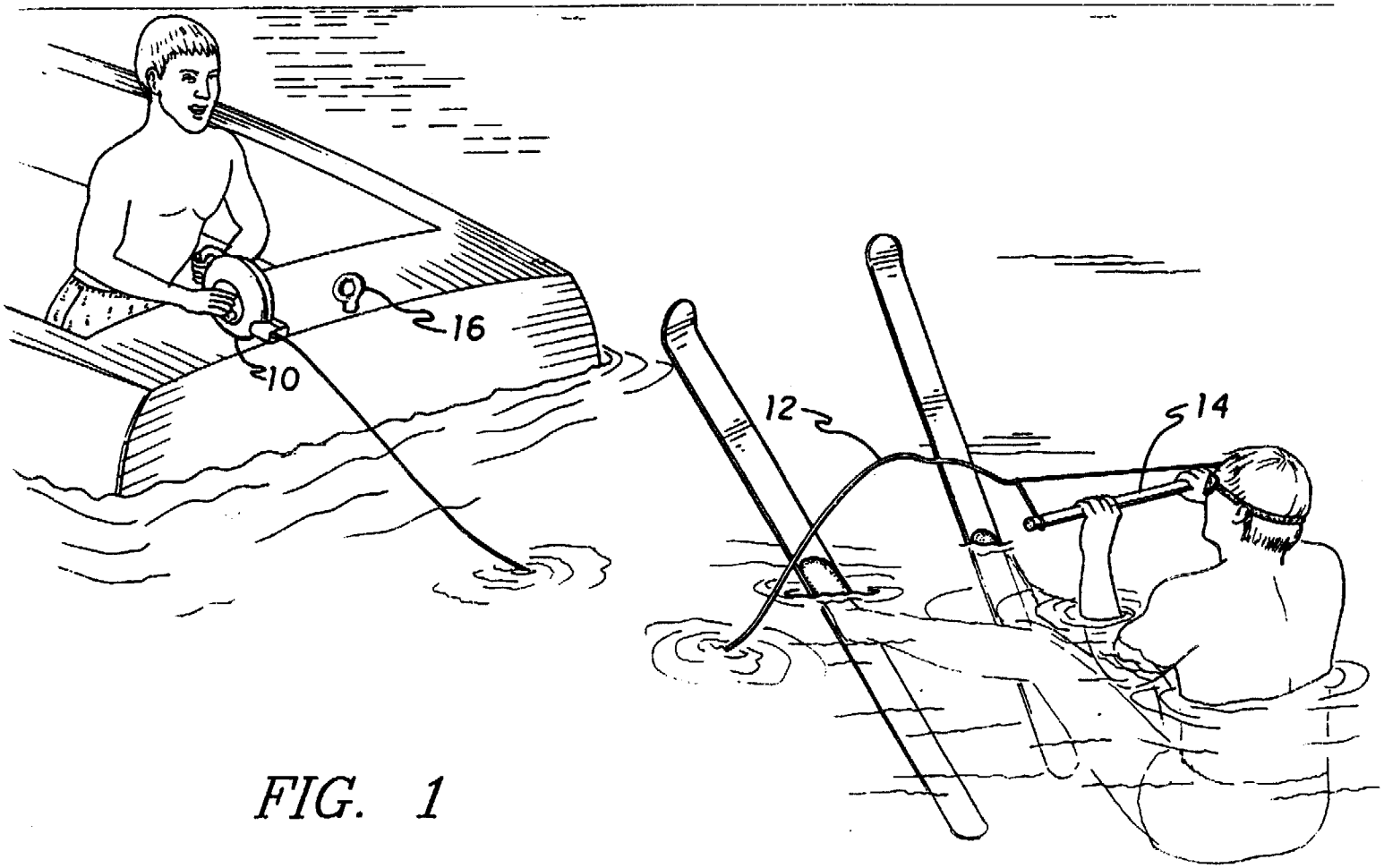
FIG. 1 is an environmental perspective view of the ski rope holder and water skiing system of the present invention.
Figure 3:
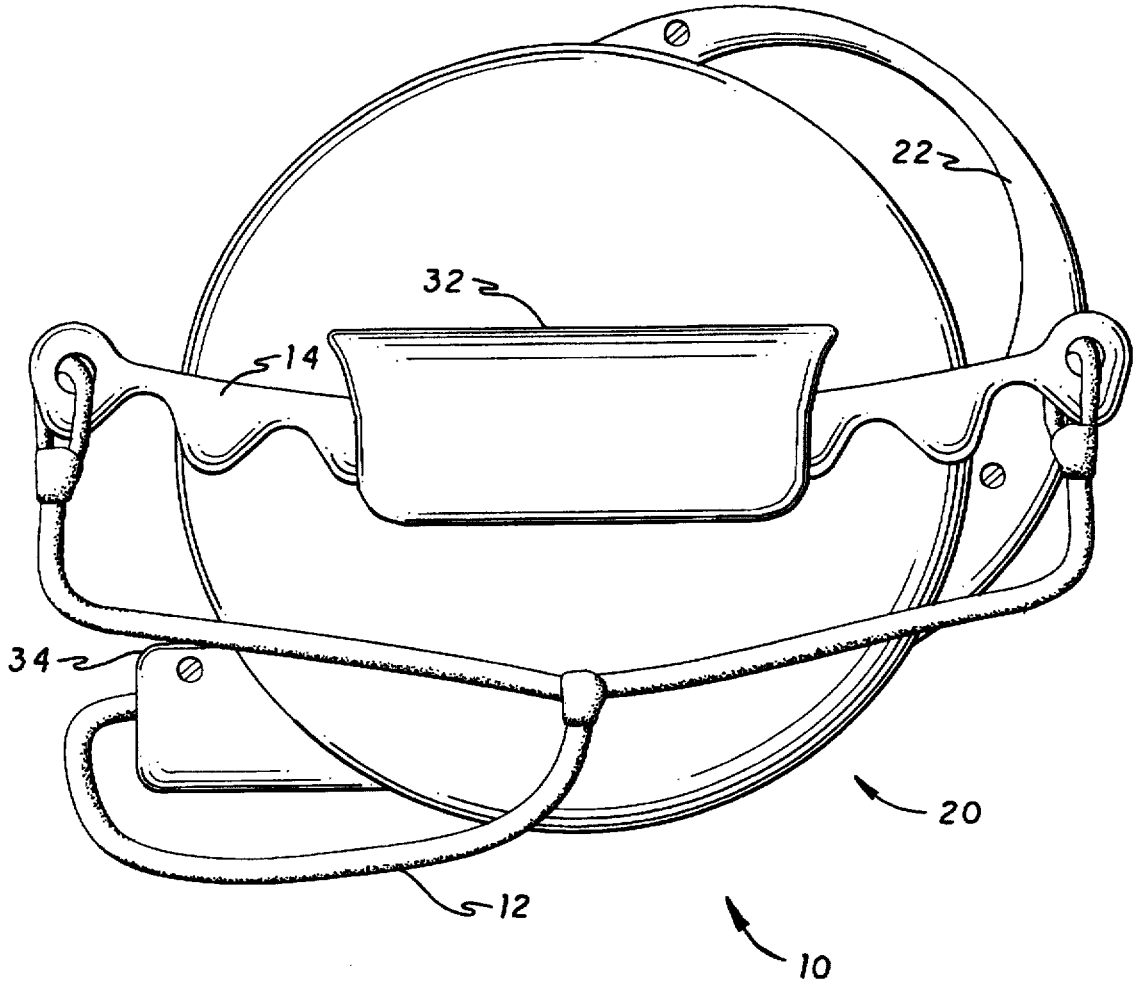
FIG. 3 is a right side elevational view of the ski rope holder showing the ski rope handle on the clip.

The novel ski rope holder 10 and system for water skiing is shown in FIG. 1. To use the novel system, the operator of the system detaches the ski rope handle 14 from the clip 32 (which is seen in FIG. 3) on the ski rope holder 10, pulls the ski rope 12 from the ski rope holder 10, and hands the ski rope handle 14 to the water skier. As the boat pulls away from the skier, the ski rope 12 is payed out from the ski rope holder 10 until the ski rope becomes taut. The operator then unhooks the ski rope 12 from the ski rope holder 10, and hooks the ski rope 12 to a hook 16, or any other known coupling means, on the side of the boat, away from the motor. Thus, the ski rope 12 will not become entangled with the motor.

To pull in the ski rope 12, it is detached from the hook 16 on the boat and attached to the ski rope holder 10. The rope is then wound in through tubular extension 34 using the reel assembly of the ski rope holder 10 (discussed in more detail below) and the ski rope handle 14 is placed on the clip 32 for storage. The present system of paying out, reeling in, and storing the ski rope prevents the rope from becoming tangled, a common problem with ski ropes.

Figure 2:
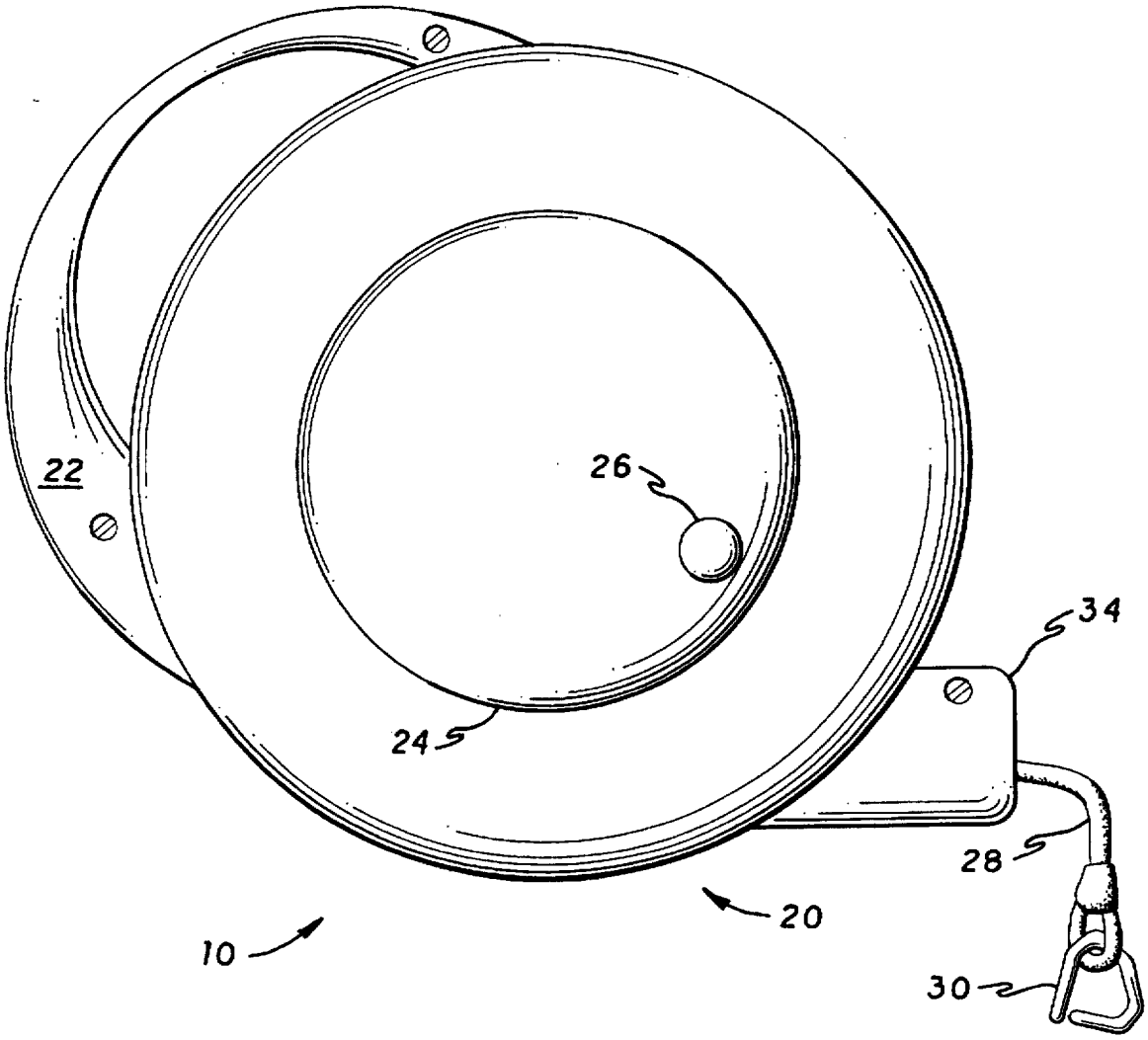
FIG. 2 is a left side elevational view of the ski rope holder, drawn to an enlarged scale.

As seen in FIG. 2, the ski rope holder 10 includes a housing 20 which has a reel assembly including a crank 24, a crank handle 26, and a spool 50 (discussed below in conjunction with FIGS. 5 and 6). A lead rope 28 is attached to the reel assembly. The reel assembly allows an operator to pay out or wind up ski rope 12 attached to hook 30, or any other known coupling apparatus, which is attached to the opposite end of the lead rope 28. Housing 20 includes a tubular extension 34 through which the lead rope 28 and the ski rope 12 pass into the interior of the housing 20. A handle 22 is mounted on the housing 20 to allow the operator to firmly grasp the ski rope holder 22.

The housing 20 also includes a clip 32, as seen in the right side view of the ski rope holder 10. FIG. 3 also shows the attachment of the ski rope handle 14 to the clip 32. When the ski rope 12 is wound inside of the housing 20, the clip 32 provides a convenient place on which to store the ski rope handle 14.

The housing 20 of the ski rope handle 10 is preferably see-through, i.e. translucent or transparent, to allow the operator to see the attachment between the ski rope 12 and the lead rope 28 of the ski rope holder 10. In order not to detract from the discussed features which appear on the outside of the housing 20, neither the internal parts nor the rope are seen through the housing 20 in this (FIG. 3) or any of the figures. Only in the cut-away views of FIGS. 5 and 6 are the internal parts seen.

Figure 4:
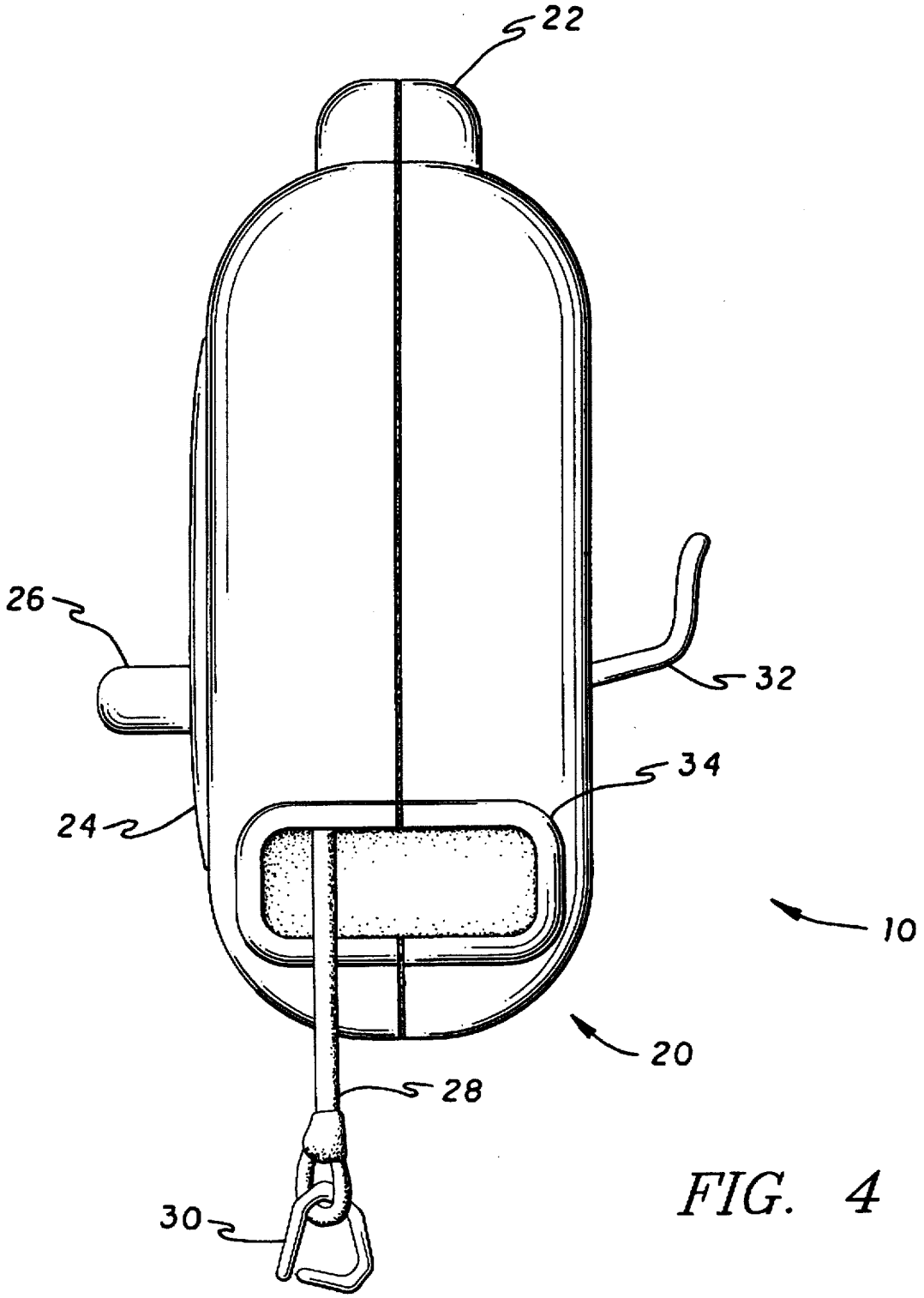
FIG. 4 is a front elevational view of the ski rope holder.
Figure 5:
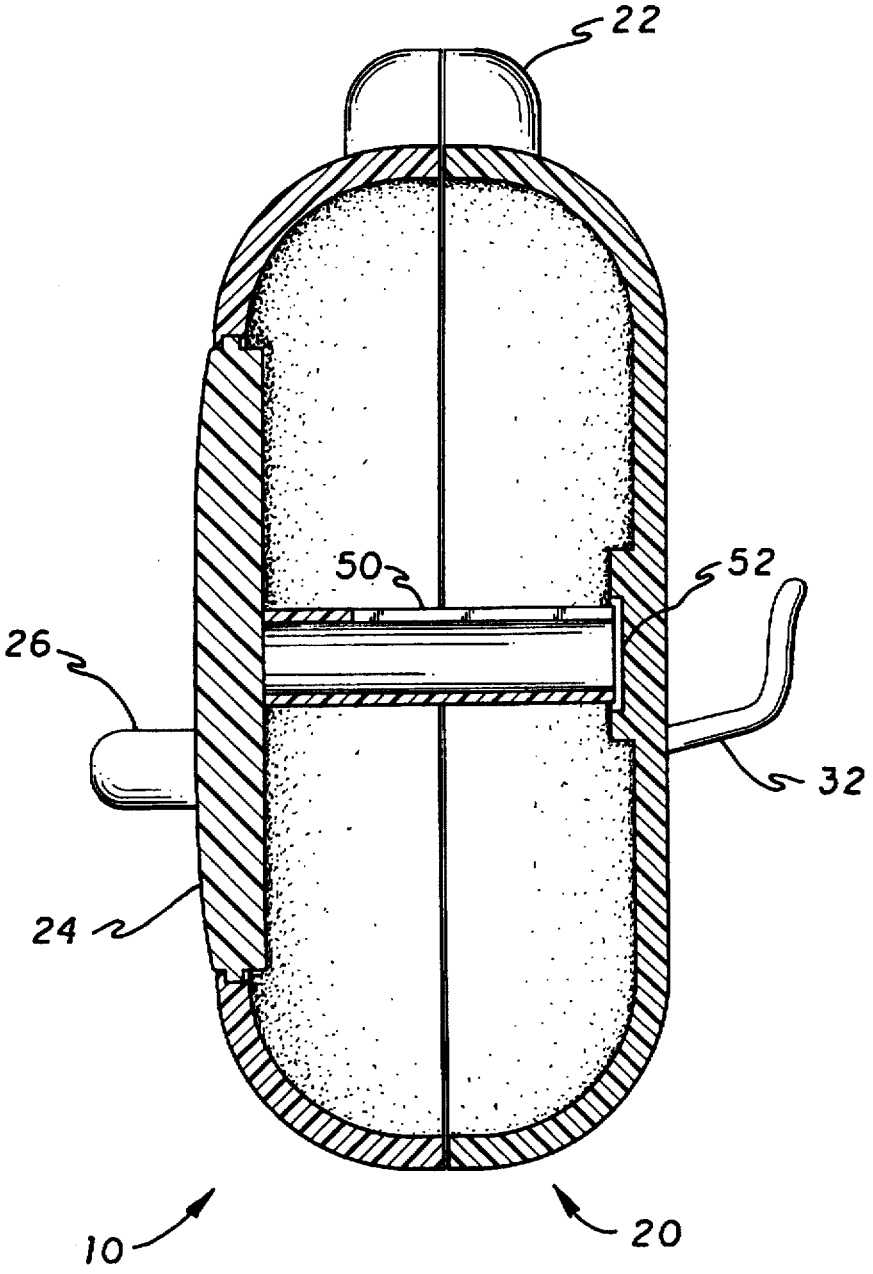
FIG. 5 is a vertical sectional view of the ski rope holder.
Figure 7:
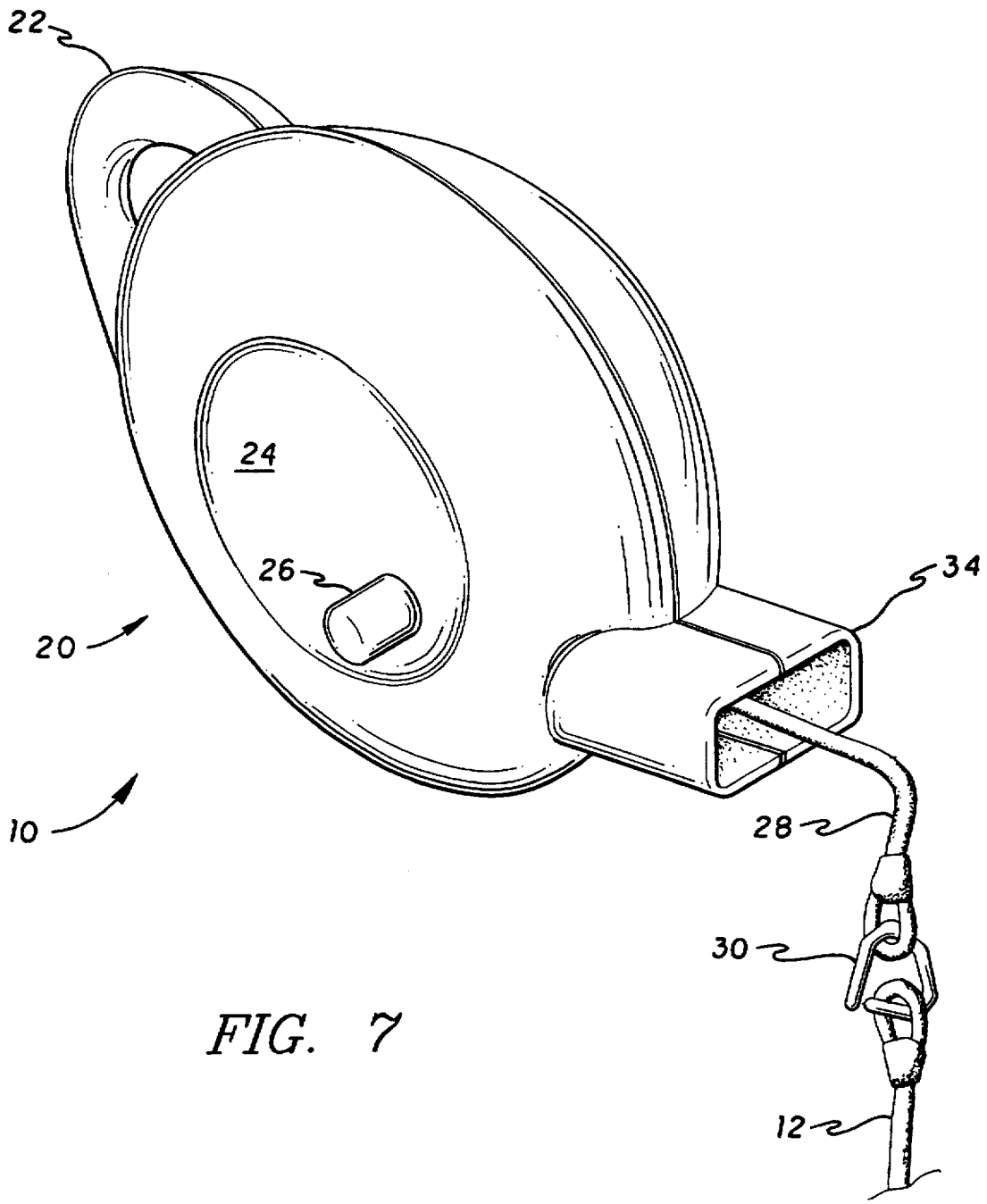
FIG. 7 is perspective view of the ski rope holder showing the lead rope attached to a ski rope.

In the front views (FIGS. 4 and 5) and perspective view (FIG. 7) of the ski rope holder 10, particularly the view shown in FIG. 5, the inner working of the ski rope holder 10 can be seen. The rotating of the crank handle 26 results in the rotation of the crank 24 and the spool 50, i.e., of the entire reel assembly. As the reel assembly is rotated, the lead line 28 and attached ski rope 12 is payed out to the skier or wound up around the spool.

Figure 6:
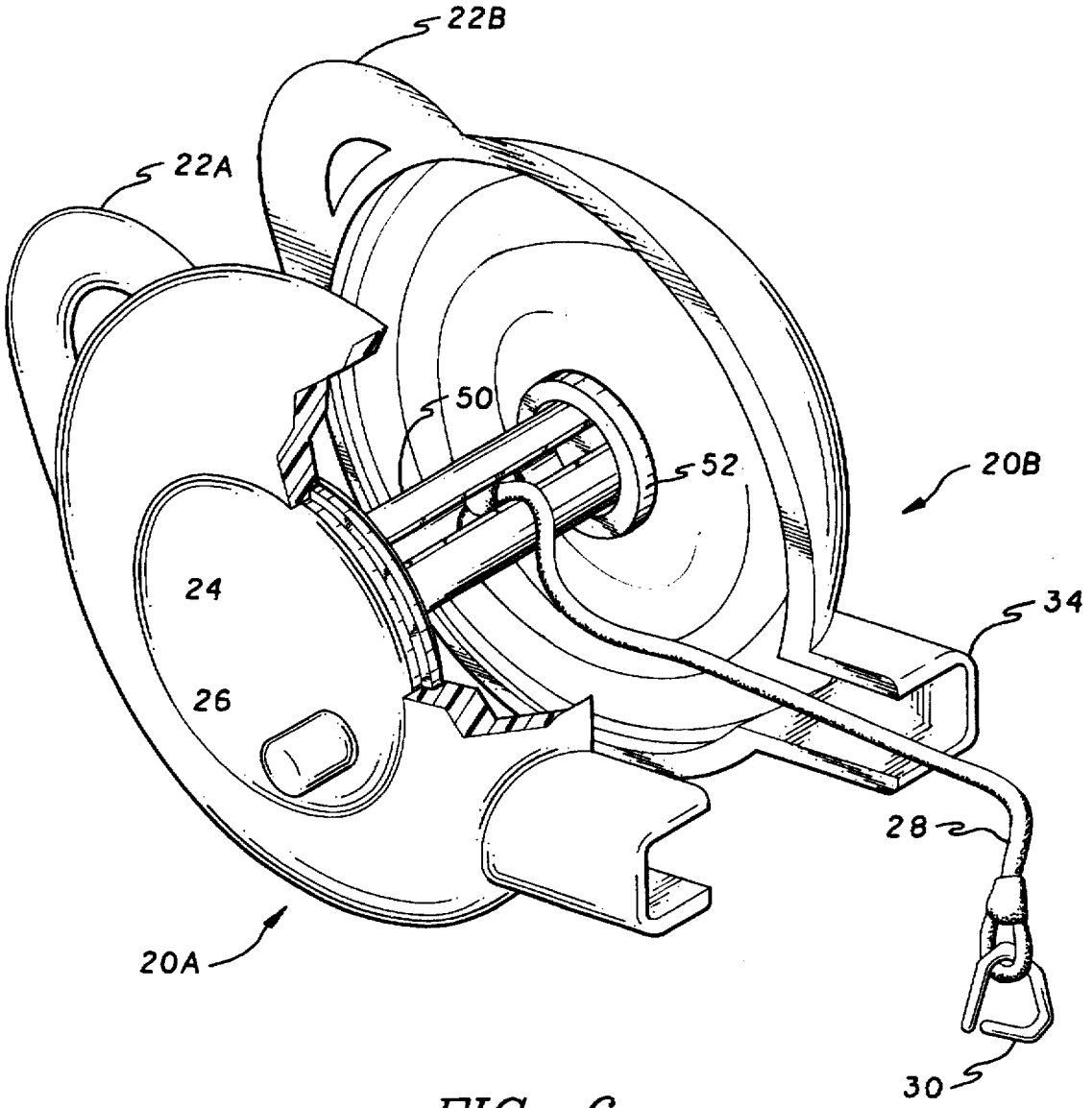
FIG. 6 is a perspective, partly exploded, partly sectional view of the ski rope holder.

As seen in the exploded view of FIG. 6, the ski rope holder 10 consists of two halves which are joined together by set screws (as seen in FIG. 3). The right and left sides of the housing 20A and 20B mount right and left handle portions 22A and 22B, respectively. Additionally, FIG. 6 shows that a spool 50 is attached to the crank 24 on the right side of the housing 20A and rotatively attached to the left side of the housing 20B by means of a ring 52 attached to the left side of the housing 20B. The spool is a slotted cylindrical sleeve such that a knot formed in the lead rope 28 fits into the slot of the spool to secure the lead rope 28 to the spool 50 and the reel assembly.

It is to be understood that the present invention is not limited to the sole embodiment described above, but encompasses any and all embodiments within the scope of the following claims.

I claim:

1. A ski rope holder comprising:

a housing having a tubular extension extending therefrom;

a reel assembly for paying out and winding up a ski rope, said reel assembly connected to said housing, said reel assembly including a crank disposed externally of said housing, and a slotted cylindrical sleeve attached to said crank such that said slotted cylindrical sleeve is rotated by turning said crank;

a lead rope having a first end and a second end, the first end of said lead rope permanently and freely secured slidable within said slotted cylindrical sleeve, said lead rope extendable through said tubular extension of said housing with said second end proximate said tubular extension upon full extension of said lead rope;

a coupling means for removably attaching said lead rope to the ski rope, said coupling means attached to the second end of said lead rope; and a clip attached to said housing, said clip for engagement with a ski rope handle.

2. The ski rope holder of claim 1 wherein said housing is see-through plastic.

3. The ski rope holder of claim 1 wherein the first end of said lead rope includes a knot secured within said slotted cylindrical sleeve.

4. The ski rope holder according to claim 1 wherein said coupling means comprises a hook.

* * * * *